US009465346B2

(12) United States Patent
Kabai

(10) Patent No.: US 9,465,346 B2
(45) Date of Patent: Oct. 11, 2016

(54) METALLIC COLOR IMAGE FORMING APPARATUS AND METALLIC COLOR IMAGE FORMING METHOD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Takahito Kabai, Mishima (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 10 days.

(21) Appl. No.: 14/312,784

(22) Filed: Jun. 24, 2014

(65) Prior Publication Data

US 2015/0370191 A1 Dec. 24, 2015

(51) Int. Cl.
*G03G 15/01* (2006.01)
*G03G 15/00* (2006.01)

(52) U.S. Cl.
CPC ..... *G03G 15/6585* (2013.01); *G03G 15/0121* (2013.01); *G03G 2215/0132* (2013.01)

(58) Field of Classification Search
None
See application file for complete search history.

(56) References Cited

U.S. PATENT DOCUMENTS

2009/0111040 A1* 4/2009 Veregin ..... G03G 9/08755 430/108.3
2010/0051165 A1* 3/2010 Tombs ..... H05K 3/1266 156/60
2010/0159373 A1* 6/2010 Tombs ..... G03G 15/1625 430/48
2011/0176842 A1* 7/2011 Fukamachi ..... G03G 15/0189 399/301
2013/0295504 A1* 11/2013 Tyagi ..... G03G 9/081 430/137.21
2014/0369701 A1* 12/2014 Kuo ..... G03G 15/50 399/15
2015/0117875 A1* 4/2015 Kubo ..... G03G 15/0848 399/15

FOREIGN PATENT DOCUMENTS

JP 2010-256613 11/2010

* cited by examiner

*Primary Examiner* — David Gray
*Assistant Examiner* — Geoffrey T Evans
(74) *Attorney, Agent, or Firm* — Amin, Turocy & Watson LLP

(57) ABSTRACT

In accordance with one embodiment, an image forming apparatus forms a metallic toner image with the toner having metallic color tone. The plurality of developing sections includes either or both of a developing section for forming a black toner image with the black toner and a developing section for forming a white toner image with the white toner. The plurality of developing sections is provided with one or more than two developing sections for forming a metallic toner image with the toner having metallic color tone.

8 Claims, 2 Drawing Sheets

METALLIC COLOR IMAGE FORMING APPARATUS AND METALLIC COLOR IMAGE FORMING METHOD

FIELD

Embodiments described herein relate generally to an image forming apparatus and an image forming method.

BACKGROUND

From a point of decoration improvement, toner containing metallic pigment has come into use in an image forming apparatus.

However, in a case of printing metallic color using conventional image forming apparatus, if a user desires to change the color tone of the metallic color, it is necessary to prepare the toner for each color tone. Further, it is not realistic for the user to prepare various kinds of toner for each color tone of the metallic color and to exchange the toner for each color tone.

DETAILED DESCRIPTION

In accordance with one embodiment, an image forming apparatus comprises an image carrier, a plurality of electrostatic latent image forming sections, a plurality of developing sections, a transfer section and a fixing section. The surface of the image carrier is charged to a given potential. The plurality of electrostatic latent image forming sections exposes the surfaces of the plurality of image carriers respectively to form electrostatic latent images. The plurality of developing sections forms a toner image on each electrostatic latent image formed on the surfaces of the plurality of image carriers. The transfer section sequentially superimposes the plurality of toner images formed by the plurality of developing sections to transfer the toner images to a transfer medium, and transfers all the toner images on the transfer medium to a recording medium. The fixing section fixes all the toner images on the recording medium. The plurality of developing sections includes either or both of a developing section for forming a black toner image with the black toner and a developing section for forming a white toner image with the white toner. The plurality of developing sections is provided with one or more than two developing sections for forming a metallic toner image with the toner having metallic color tone.

The image forming apparatus according to the embodiments is described below with reference to the accompanying drawings.

A First Embodiment

Figure 1:
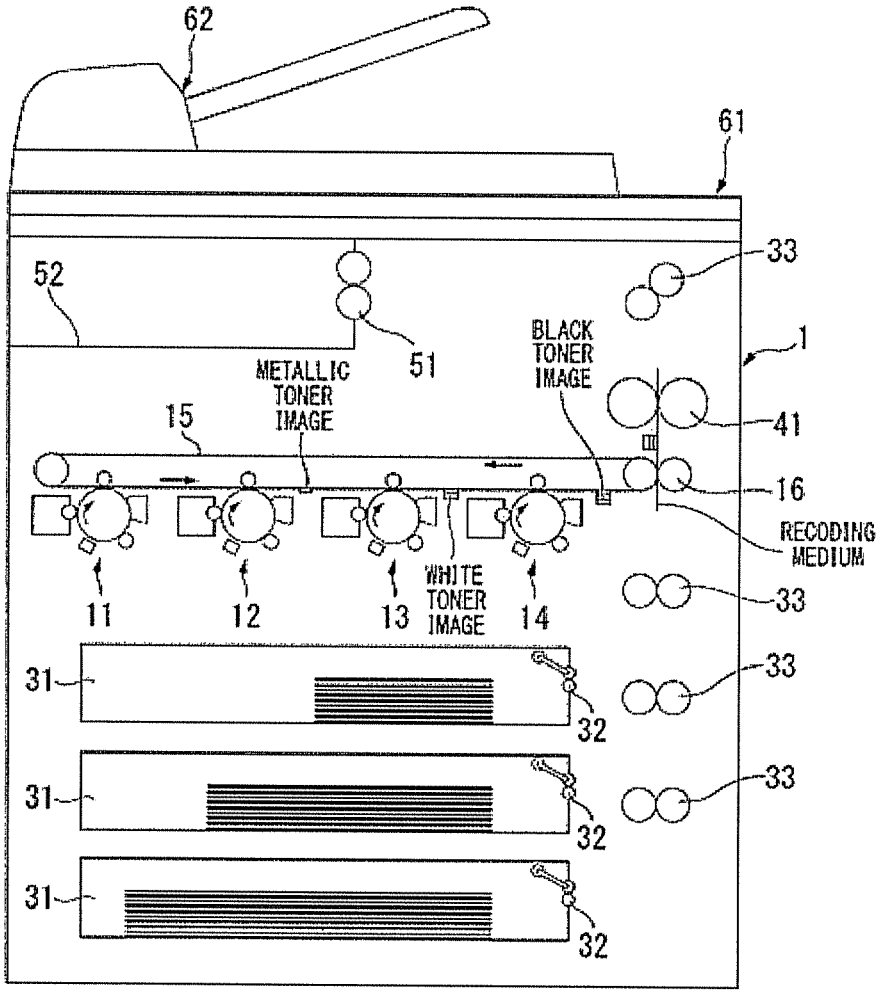
FIG. 1 is a schematic cross-sectional view illustrating an image forming apparatus according to a first embodiment.
Figure 2:
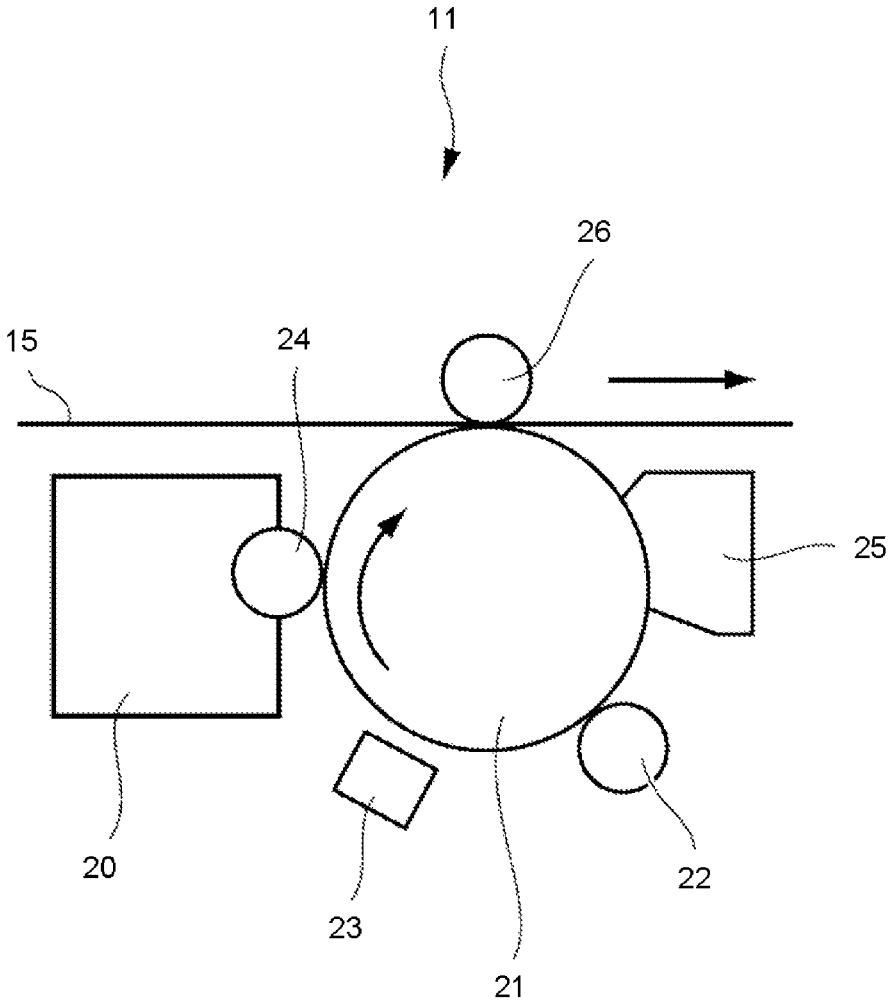
FIG. 2 is an enlarged cross-sectional view schematically illustrating a first image generation unit in FIG. 1.

FIG. 1 is a schematic cross-sectional view illustrating an image forming apparatus 1 according to the present embodiment. FIG. 2 is an enlarged cross-sectional view schematically illustrating a first image generation unit 11 in FIG. 1.

As shown in FIG. 1, the image forming apparatus 1 according to the present embodiment comprises a first image generation unit 11, a second image generation unit 12, a third image generation unit 13, a fourth image generation unit 14, a transfer belt 15, a secondary transfer roller 16, a cassette 31, a recording medium feed roller 32, a recording medium conveyance roller 33, a fixing roller 41, a recording medium discharge roller 51, a discharge tray 52, a document image reading device 61 and an automatic document feeder 62.

Each component of the image forming apparatus 1 is described below.

The document image reading device 61 and the automatic document feeder 62 are arranged at the upper portion of the image forming apparatus 1 in an openable/closable manner. The document image reading device 61 is provided with an exposure lamp for exposing the document, a carriage including a first reflecting mirror, a plurality of second reflecting mirrors locked to a main body frame of the image forming apparatus 1, a lens block and a CCD (Charge Coupled Device) serving as an image reading sensor.

The carriage of the document image reading device 61 keeps still or reciprocates to reflect the light of the exposure lamp reflected by the document to the first reflecting mirror. The plurality of second reflecting mirrors reflects the light reflected by the first reflecting mirror to the lens block. The lens block outputs the reflected light to the CCD. The CCD converts the incident light into an electric signal.

The automatic document feeder 62 conveys the documents one by one to the document image reading device 61, and the document image reading device 61 reads the image on the document.

An image is formed on the recording medium while the recording medium is conveyed. For example, paper like printing paper, a resin sheet and the like may be listed as the recording medium used in the present embodiment.

The conveyance path of the recording medium starts form the cassette 31 and ends at the discharge tray 52. The recording medium feed roller 32, the secondary transfer roller 16, the fixing roller 41 and the recording medium discharge roller 51 are arranged on the conveyance path in order from the upstream side to the downstream side of the conveyance direction of the recording medium. Further, the recording medium conveyance rollers 33 are arranged on the conveyance path of the recording medium as needed.

The first image generation unit 11, the second image generation unit 12, the third image generation unit 13, the fourth image generation unit 14 and the secondary transfer roller 16 are arranged in sequence along the transfer belt 15 in the running direction of the transfer belt 15. The first image generation unit 11, the second image generation unit 12, the third image generation unit 13 and the fourth image generation unit 14 are structurally identical to each other.

For example, as shown in FIG. 2, the first image generation unit 11 is provided with a developer 20, a photoconductive drum 21, a charging roller 22, a laser radiation device 23, a developing roller 24, a cleaner 25 and a primary transfer roller 26. Further, in the first image generation unit 11, the photoconductive drum 21 and the primary transfer roller 26 are arranged opposite to each other across the transfer belt 15.

The photoconductive drum 21 serves as the image carrier. The surface of the photoconductive drum 21 is charged to a given potential.

The laser radiation device 23 serves as the electrostatic latent image forming section. The laser radiation device 23 exposes the surface of the photoconductive drum 21 respectively to form an electrostatic latent image.

The developer 20 and the developing roller 24 serve as the developing section. The developer 20 and the developing roller 24 form a toner image on each electrostatic latent image formed on the surface of the photoconductive drum 21.

The transfer belt 15 serves as the transfer medium. Further, the primary transfer roller 26 and the secondary transfer roller 16 serve as the transfer section. The primary transfer roller 26, the transfer belt 15 and the secondary transfer roller 16 transfer the toner image formed by the developer 20 and the developing roller 24 to the transfer medium, and transfer the toner image on the transfer medium to the recording medium.

The fixing roller 41 serves as the fixing section. The fixing roller 41 fixes the toner image on the recording medium.

An image generation operation is carried out based on the electric signal sent from the document image reading device 61 in the first image generation unit 11, the second image generation unit 12, the third image generation unit 13 and the fourth image generation unit 14. Specifically, the surface of the photoconductive drum 21 is processed by the charging roller 22, the laser radiation device 23 and the developing roller 24 in sequence while the photoconductive drum 21 is rotated. More specifically, first, the charging roller 22 charges the surface of the rotating photoconductive drum 21 with uniform static. Next the laser radiation device 23 forms (electrostatic latent image forming process) the electrostatic latent image on the surface of the photoconductive drum 21. Then the developing roller 24 adheres (developing process) the toner in the developer 20 to the surface of the photoconductive drum 21. Through these processing, the toner image is developed on the surface of the photoconductive drum 21 based on the received electric signal. The toner adhered to the surface of the photoconductive drum 21 is primarily transferred to the outer surface of the transfer belt 15.

The toner which is not transferred to the transfer belt 15 and is left on the surface of the photoconductive drum 21 is collected by the cleaner 25. The surface of the photoconductive drum 21 is cleaned by the cleaner 25, thus, the image generation operation can be carried out repeatedly.

The recording medium is stored in the cassette 31 and is fed to the recording medium conveyance path by the recording medium feed roller 32. The recording medium is conveyed to the inside of the image forming apparatus 1 by the recording medium conveyance rollers 33 which are arranged as needed. The toner primarily transferred to the transfer belt 15 is secondarily transferred to the conveyed recording medium by the secondary transfer roller 16. The toner transferred to the recording medium is heated, pressed and fixed (fixing process) on the recording medium between the roller pair of the fixing roller 41. In this way, an image is printed on the recording medium. The printed recording medium is discharged to the discharge tray 52 by the recording medium discharge roller 51.

A method of filling toner is described below.

In the present embodiment, either or both of the black toner and the white toner, and one or more than two types of toner having the metallic color tone are used. It is preferred in the present embodiment that the black toner, the white toner and one or more than two types of toner having the metallic color tone are used.

Each toner is filled in the developer of either of the first image generation unit 11, the second image generation unit 12, the third image generation unit 13 and the fourth image generation unit 14. In the present embodiment, it is preferred that after one or more than two types of toner having the metallic color tone are primarily transferred to the transfer belt 15, either or both of the black toner and the white toner is superimposed and primarily transferred on the toner having the metallic color tone. In a case of using both of the black toner and the white toner, the primary transfer order of the black toner and the white toner is not limited. Thus, for example, the toner having the metallic color tone may be filled in the first image generation unit 11 and the second image generation unit 12, and the black toner and the white toner may be filled in the third image generation unit 13 and the fourth image generation unit 14. In this way, in the secondary transfer to the recording medium, the image formed by one or two types of toner having the metallic color tone is formed on the surface side of all the images formed by other toner. If the image formed by one or two types of toner having the metallic color tone is formed on the surface side, the diversity of the color tones of the metallic image is further improved.

In the image forming apparatus 1 according to the present embodiment, the method of filling toner is described using an "image forming section". The image forming apparatus 1 comprises a plurality of image forming sections including, for example, an image forming section A, an image forming section B and an image forming section C.

The image forming section A includes an image carrier, an electrostatic latent image forming section and a developing section. White toner is stored in the developing section of the image forming section A.

The image forming section B, the same as the image forming section A, includes an image carrier, an electrostatic latent image forming section and a developing section. Black toner is stored in the developing section of the image forming section B.

The image forming section C, the same as the image forming section A, includes an image carrier, an electrostatic latent image forming section and a developing section. The toner having metallic color tone is stored in the developing section of the image forming section C.

The image forming section A, the image forming section B and the image forming section C are arranged along the running direction of the transfer medium. The arrangement order of the image forming section A, the image forming section B and the image forming section C arranged along the transfer medium is properly set. It is preferred that the image forming section C provided with the developing section in which the toner having metallic color tone is stored is arranged at the upstream side of other image forming sections in the running direction of the transfer medium.

The method of manufacturing toner is described below.

No specific limitation is given to the method of manufacturing toner, and a well-known toner manufacturing method may be used. For example, an aggregation and fusion method, a kneading and grinding method, an emulsion polymerization method, a phase inversion emulsification method and the like can be used as the toner manufacturing method. In a case of manufacturing one or more than two types of toner having metallic color tone, from a point of view where the metallic color tone of the image becomes stronger if the exposure of pigment on the toner surface is reduced and the particle diameter and the shape of toner are made equal to the particle diameter and the shape of the pigment, the aggregation and fusion method is preferred.

The pigment used in toner may be properly selected from well-known materials. For example, carbon black is listed as the pigment used in the black toner. Acetylene black, furnace black, thermal black, channel black, ketjen black and the like may be listed as the specific carbon black.

For example, titanium oxide, zinc oxide, lithopone and the like may be listed as the pigment used in the white toner.

As the pigment used in one or more than two types of toner having metallic color tone, metallic powder such as aluminum, brass, bronze, nickel, stainless, zinc and the like; coated flaky inorganic crystal substrate such as mica, barium sulfate, layered silicate, silicate of layered aluminum and the like; single crystal plate titanium oxide; basic carbonate; acid bismuth oxychloride; natural guanine; flake-like glass powder; metallized flaky glass powder and the like are listed. In these components, from a point of raising the electrical resistance of the toner, the main component of one or more than two types of toner having metallic color tone is preferred to be the non-metallic pigment. From a point of achieving more excellent color generation property, the main component of one or more than two types of toner having metallic color tone is preferred to be the mica.

In addition to the pigments mentioned above, the toner is preferred to include binder resin, mold releasing agent, charge controlling agent, surfactant, external additive and the like, which can improve the function of the toner.

No specific limitation is given to the category of the binder resin. For example, polyester resin, styrene resin, ethylene resin, acrylic resin, phenolic resin, epoxy resin, allyl phthalate resin, polyamide resin, maleic acid resin and the like are listed as the binder resin.

No specific limitation is given to the category of the mold releasing agent. For example, aliphatic hydrocarbon based wax such as low molecular weight polyethylene, low molecular weight polypropylene, polyolefin copolymer, polyolefin wax, paraffin wax, fischer-tropsch wax and the modified material thereof; vegetable wax such as candelilla wax, carnauba wax, Japan wax, jojoba wax, rice wax and the like; animal wax such as bees wax, lanolin, whale wax and the like; mineral wax such as montan wax, ogesoraito, ceresin and the like; fatty acid amide such as linoleic acid amide, oleic acid amide, lauric acid amide and the like; functionality synthetic wax; silicone wax and the like are listed as the mold releasing agent.

No specific limitation is given to the category of the charge controlling agent. For example, metal-containing azo compound and metal-containing salicylic acid derivative compound are listed as the charge controlling agent. The metal element of the metal-containing azo compound is preferred to be iron, cobalt, chromium complex, complex salt or the mixture thereof. The metal element of the metal-containing salicylic acid derivative compound is preferred to be zirconium, zinc, chromium, boron complex, complex salt or the mixture thereof.

No specific limitation is given to the category of the surfactant. For example, anionic surfactant such as sulfate based, sulfonate based, phosphate based, fatty acid salt-based and the like; cationic surfactant such as amine salt type, quaternary ammonium salt type and the like; amphoolytic surfactant such as betaine based; nonionic surfactant such as polyethylene glycol based, alkylphenol ethylene oxide adduct based, and polyhydric alcohol based; and high molecular surfactant such as polycarboxylic acid are listed as the surfactant.

No specific limitation is given to the category of the external additive. For example, inorganic particle for granting fluidity and charging property to the toner is listed as the external additive. Silica, titania, alumina and strontium titanate, tin oxide and the like are listed as the inorganic particle. From a point of environmental stability improvement, the inorganic particle is preferred to be a material the surface of which is processed using hydrophobic agent.

In a case of manufacturing toner using the aggregation and fusion method, coagulating agent is used. For example, monovalent or polyvalent metal salt such as sodium chloride, potassium chloride, ammonium sulfate, magnesium sulfate and aluminum sulfate; pH adjuster such as hydrochloric acid; organic coagulating agent such as dimethyl diallyl ammonium chloride homopolymer and the like are listed as the coagulating agent.

The toner is mixed with carrier and filled in the developer. Ferrite carrier coated with resin with a charging property and the like are listed as the carrier. In these carriers, the carrier is preferred to be the ferrite carrier coated with silicone resin.

In the present embodiment, when carrying out printing using the image forming apparatus 1, the combination of the toner which is synchronously filled in the first image generation unit 11, the second image generation unit 12, the third image generation unit 13 and the fourth image generation unit 14 is referred to as a set of toner set.

Next, the image forming method according to the present embodiment is described.

The image forming method according to the present embodiment includes an electrostatic latent image forming process, a developing process, a transfer process and a fixing process. The electrostatic latent image forming process respectively exposes the surfaces of the plurality of image carriers which are charged to a given potential to form the electrostatic latent image. The developing process forms the toner image on each electrostatic latent image formed on the surfaces of the plurality of image carriers. The transfer process sequentially superimposes the plurality of toner images formed by the plurality of developing sections to transfer the toner images to the transfer medium, and transfers all the toner images on the transfer medium to the recording medium. The fixing process fixes all the toner images on the recording medium. The transfer process includes the primary transfer and the secondary transfer. In the primary transfer, one or more than two metallic toner images are formed on the transfer medium with the toner having metallic color tone. Sequentially, either or both of the black toner image based on the black toner and the white toner image based on the white toner is formed on the metallic toner image on the transfer medium. In the secondary transfer, the metallic toner image, and either or both of the black toner image and the white toner image on the transfer medium are transferred to the recording medium.

Each component of the image forming method according to the present embodiment is described.

The electrostatic latent image forming process, the developing process and the fixing process are the same as described above. Herein, the transfer process is described.

For example, the transfer belt 15 is listed as the transfer medium.

The transfer process includes the primary transfer and the secondary transfer.

In the primary transfer, first, one or more than two types of toner having metallic color tone is transferred to the transfer medium. In this way, the metallic toner image is formed on the transfer medium. Next, either or both of the black toner and the white toner are transferred on the metallic toner image on the transfer medium. In this way, a synthesized toner image superimposed on the metallic toner image on the transfer medium is formed.

After one or more than two metallic toner images are formed on the transfer medium with the toner having metallic color tone, the transfer process is preferred to include the primary transfer of forming the black toner image based on the black toner and the white toner image based on the white toner on the metallic toner image on the transfer medium, and the secondary transfer of transferring the metallic toner image, the black toner image and the white toner image on the transfer medium to the recording medium.

In the secondary transfer, the synthesized toner image and the metallic toner image are transferred to the recording medium. In this way, the synthesized toner image and the metallic toner image are superimposed on the recording medium in this order.

Then, the recording medium is passed through the fixing roller 41 to fix each toner on the recording medium. In this way, the image is printed on the recording medium.

The synthesized toner image may be an image including the black toner merely, or an image including the white toner merely, or an image including both the black toner and the white toner.

The image only including the black toner lowers the brightness of the recording paper surface and can adjust the brightness to a desired value. For example, the brightness of the recording medium surface can be lowered and the recording medium can be made achromatic by forming the image only including the black toner on the recording medium which is slightly colored and is of low quality. Further, the brightness of the recording medium surface which has high brightness originally can be lowered and the recording medium can be made achromatic by forming the image only including the black toner on a white recording medium.

The image only including the white toner increases the brightness of the recording paper surface and can adjust the brightness to a desired value. For example, the brightness of the recording medium surface can be increased and the recording medium can be made achromatic by forming the image only including the white toner on the recording medium which is slightly colored and is of low quality.

Further, in the image including both the black toner and the white toner, a gray image is formed. The brightness of the recording medium can be adjusted to a desired value by forming a gray image on the surface of the recording medium. In addition, the brightness of gray can be adjusted in stages by adjusting the percentage of the black toner and the white toner.

As stated above, in the present embodiment, first, the brightness of the recording medium itself is adjusted through the synthesized toner image.

In the present embodiment, the color tone of the metallic toner image is affected by the brightness of the background. In the present embodiment, as the metallic toner image is superimposed on the synthesized toner image, the synthesized toner image becomes the background. Then, as the brightness of the recording medium is adjusted through the synthesized toner image, the metallic toner image can be represented in various color tones such as bright color tone, deep color tone and the like.

In accordance with the first embodiment, the metallic image of various color tones, which can hardly be printed with only a set of toner set conventionally, can be printed with a set of toner set.

A Second Embodiment

The second embodiment is described below.

The present embodiment is a modification of the first embodiment described above.

The image formed by the image forming apparatus 1 according to the present embodiment is not limited to the copy of the image read by the document image reading device 61. The image formed by the image forming apparatus 1 may be, for example, an image pattern formed through an operation on an operation screen which will be described later, a pattern created on a computer, or a photograph captured by a digital camera. In this case, an image generation operation is carried out in the first image generation unit 11, the second image generation unit 12, the third image generation unit 13 and the fourth image generation unit 14 based on the electric signal sent from a computer and the like.

The image forming apparatus 1 according to the present embodiment may include a function of setting the color concentration of the image, the image pattern, the size of the recording medium, the number of printings and the like on the operation screen. The function is preferred to be a function of selecting whether to form the pattern of the metallic toner image automatically or to form the pattern of the metallic toner image to be selectable from a plurality of patterns.

Further, in the image forming method according to the present embodiment, a user sets (operation process) the color concentration of the image, the image pattern, the size of the recording medium, the number of printings and the like through the operation screen. The operation process is preferred to be a process of selecting whether to form the pattern of the toner image based on the toner having metallic color tone automatically or to form the pattern of the toner image to be selectable from a plurality of patterns.

In accordance with the second embodiment described above, the convenience of the image forming apparatus 1 is improved.

In accordance with at least one of the embodiments described above, an image forming apparatus and an image forming method can be provided which can adjust the brightness of the background using either or both of the black toner and the white toner and form a metallic image with the toner including metallic pigment on the background, thereby forming a metallic image of various color tones even with one set of toner set.

The following example describes one example of the present embodiment. However, the present embodiment is not limited to the present example.

The following materials are used as the raw materials of the toner in the present example.

binder resin: polyester resin (manufactured by Kao Corp.)

mold releasing agent: rice wax (manufactured by Boso Oil Industrial Co. "SS-1")

charge controlling agent: zirconia complex (manufactured by Hodogaya Chemical Co., Ltd. "TN-105")

black pigment: carbon black (manufactured by Mitsubishi Chemical Corporation "MA100")

white pigment: titanium oxide (manufactured by Ishihara Sangyo Kaisha, Ltd. "CR63")

gold color pigment: Iriodin323 (manufactured by Merck & Co., Inc., volume particle diameter: 5-25 μm)

surfactant: PELEX-SSL (manufactured by Kao Corp.)

external additive: negative charge type silica (manufactured by Nippon Aerosil Co., Ltd. "R974")

The black toner and the white toner are manufactured through a general kneading and grinding method, as will be described below.

First, the composition of toner particle described below is kneaded by a biaxial continuous kneader and is grinded and classified by an impact grinder and an air flow classifier.

These operations are carried out so that the volume average particle diameter of the toner particle of each color is 8 μm.

The composition of the black toner particle:

polyester resin: 90 mass % carbon black: 6 mass % rice wax: 3 mass % zirconia complex: 1 mass % the composition of white toner particle:

polyester resin: 90 mass % titanium oxide: 6 mass % rice wax: 3 mass % zirconia complex: 1 mass %

The negative charge type silica serving as the external additive is added to the toner particle until the concentration of the negative charge type silica becomes 2 mass %. After the addition, the toner particle and the external additive are mixed by Henschel mixer (manufactured by Mitsui Mining Co., Ltd.).

In this way, the black toner and the white toner are manufactured.

The toner having metallic color tone is manufactured through the aggregation and fusion method, as will be described below.

First, the materials of the resin fine particle dispersion described below are mixed by a dry mixer, and then are melt-kneaded using a biaxial kneader, thereby the composition including the resin fine particle is manufactured.

The materials of the resin fine particle dispersion:

polyester resin: 94 mass % rice wax: 5 mass % zirconia complex: 1 mass %

Next, the composition including the resin fine particle is grinded by a pin mill grinder, and is sieved by a mesh of 2 mm. Next, 30 mass % of grinded composition including the resin fine particle, 0.9 mass % of PELEX-SSL serving as the surfactant and 0.45 mass % of dimethylaminoethanol serving as neutralizing agent are dispersed in 68.65 mass % of pure water, in this way, the resin dispersion is manufactured. Next, an atomization processing is carried out using a high pressure homogenizer (manufactured by Beryu Corporation "Nano3000") so that the volume average particle diameter of the particle in the resin dispersion is about 200 nm. In this way, the resin fine particle dispersion is manufactured.

On the other hand, the dispersion of gold color pigment is manufactured by dispersing Iriodin323 in the water serving as dispersion medium. The dispersion is manufactured in such a manner that the concentration of the Iriodin323 is 6 mass %.

The dispersion of gold color pigment and the resin fine particle dispersion are mixed so that the Iriodin323 is 30 mass % with respect to the solid content 100 mass %. Next, the temperature of the mixture liquid of the gold color pigment and the resin fine particle is raised to 40 degrees centigrade. Then aluminum sulfate serving as the coagulating agent is added to the mixture liquid while mixture liquid is being stirred. In this way, coagulated particle of the gold color pigment and the resin fine particle is formed. Then, the mixture liquid is stirred and meanwhile heated to 80 degrees centigrade gradually. In this way, the gold color pigment and the resin fine particle are fused. The fusion is carried out so that the fused particle of which the volume average particle diameter is 30 μm is formed. The filtration of the dispersion containing the fused particle and the redispersion of the fused particle to the pure water are carried out repeatedly, thereby rinsing the fused particle. Then the fused particle is dried by a drier until the water content becomes less than 1 mass %. In this way, the toner particle having metallic color tone is manufactured. The negative charge type silica serving as external additive is added to the toner particle until the concentration of the negative charge type silica becomes 1.5 mass %.

In this way, the toner having metallic color tone is manufactured.

The printing processing using the developing agent containing each toner mentioned above is carried out as described below.

First, the developing agent containing each toner is manufactured by mixing the black toner, the white toner or the toner having metallic color tone with the ferrite carrier coated with the silicone resin in such a manner that the concentration of the toner is 5 mass %.

The printing is carried out using the image forming apparatus (manufactured by Toshiba Tec Corporation, e-Studio2540C) provided with the components shown in FIG. 1. The developing agent containing the toner having metallic color tone is set in the second image generation unit. The developing agent containing the white toner is set in the third image generation unit. The developing agent containing the black toner is set in the fourth image generation unit. That is, these developing agents are set in such a manner that the image formed with the toner having metallic color tone is formed on the surface side of the image formed with either or both of the black toner and the white toner on the recording medium. In addition, in the present example, the first image generation unit is not used.

The evaluation result of the present example is described below using the following examples 1~4 and the comparative embodiment 1.

EXAMPLE 1

The image based on the toner having metallic color tone is printed on the image printed on the printing paper with the white toner.

As a result, an image having bright metallic color tone is formed.

EXAMPLE 2

The image based on the toner having metallic color tone is printed on the image printed on the printing paper with the black toner.

As a result, an image having deep metallic color tone is formed.

EXAMPLE 3

The image based on the toner having metallic color tone is printed on the gray image printed on the printing paper with the black toner and the white toner.

As a result, an image having color tone of which the brightness is between that in the example 1 and that in the example 2 is formed.

EXAMPLE 4

The image based on the toner having metallic color tone is printed, with a random image pattern of 100 μm~500 μm, on the image which is printed on the printing paper with the black toner and the white toner.

As a result, an image pattern having various metallic color tones is obtained. The image pattern exudes a sense of luxury.

Comparative Embodiment 1

The image based on the toner having metallic color tone is directly printed on the printing paper.

As a result, an image having conventional metallic color tone is formed.

The results of the examples 1~4 and the comparative embodiment 1 are considered.

As stated in the comparative embodiment 1, in a case of directly printing the image with the toner having metallic color tone on the printing paper, only an image having single metallic color tone is formed.

On the contrary, as stated in the examples 1~3, in a case of printing the image based on the toner having metallic color tone on the image which is printed on the printing paper with either or both of the black toner and the white toner, an image having various color tones can be printed. Further, in this case, as shown in example 4, an image of a complex image pattern can be printed.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a plurality of image carriers of which the surfaces are charged to a given potential;

a plurality of electrostatic latent image forming sections configured to expose the surfaces of the plurality of image carriers respectively to form electrostatic latent images;

a plurality of developing sections configured to form a toner image on each electrostatic latent image formed on the surfaces of the plurality of image carriers;

a transfer section configured to sequentially superimpose the plurality of toner images formed by the plurality of developing sections to transfer the toner images to a transfer medium, and transfer all the toner images on the transfer medium to a recording medium; and a fixing section configured to fix all the toner images on the recording medium; wherein the plurality of developing sections include a developing section for forming a black toner image with black toner, a developing section for forming a white toner image with white toner, and one or no less than two developing sections for forming a metallic toner image with toner having metallic color tone, the metallic toner image is arranged on an image comprised of the black toner image and the white toner image on the recording medium, and the developing section for forming the black toner image and the developing section for forming the white toner image have a function of adjusting percentages of the black toner and the white toner so as to adjust brightness of the image.

2. The image forming apparatus according to claim 1, wherein the plurality of developing sections are arranged along the running direction of the transfer medium respectively, and the one or no less than two developing sections for forming the metallic toner image are arranged at the upstream side of other developing sections in the running direction.

3. The image forming apparatus according to claim 1, wherein the main component of the toner having metallic color tone is mica.

4. The image forming apparatus according to claim 1, further comprising:

a function of selecting whether to form a pattern of the metallic toner image automatically or to form the pattern of the metallic toner image to be selectable from a plurality of patterns.

5. An image forming method, including:

an electrostatic latent image forming process of respectively exposing the surfaces of a plurality of image carriers which are charged to a given potential to form electrostatic latent images;

a developing process of forming a toner image on each electrostatic latent image formed on the surfaces of the plurality of image carriers by using a plurality of developing sections;

a transfer process of sequentially superimposing the plurality of toner images formed by the plurality of developing sections to transfer the toner images to a transfer medium, and transferring all the toner images on the transfer medium to a recording medium;

a fixing process of fixing all the toner images on the recording medium, wherein the transfer process includes a primary transfer in which one or no less than two metallic toner images with toner having metallic color tone are formed on the transfer medium, and then a black toner image based on black toner and a white toner image based on white toner are formed on the one or no less than two metallic toner images on the transfer medium; and a secondary transfer in which the one or no less than two metallic toner images, the black toner image and the white toner image on the transfer medium are transferred to the recording medium, and percentages of the black toner and the white toner are adjusted so as to adjust brightness of an image comprised of the black toner image and the white toner image.

6. The image forming method according to claim 5, wherein the main component of the toner having metallic color tone is mica.

7. The image forming method according to claim 5, further including:

an operation process of selecting whether to form a pattern of the toner image based on the toner having metallic color tone automatically or to form the pattern of the toner image to be selectable from a plurality of patterns.

8. The image forming method according to claim 5, wherein the one or no less than two metallic toner images are arranged at the top of the toner images on the recording medium.

* * * * *